US007909195B2

(12) United States Patent
Rathbone et al.

(10) Patent No.: US 7,909,195 B2
(45) Date of Patent: Mar. 22, 2011

(54) TWO-PIECE CONTAINER LID ASSEMBLY

(75) Inventors: Jon Rathbone, Wolfverhampton (GB); Katie Hernandez, Chicago, IL (US); Tyler Simpson, Chicago, IL (US); Russ Schweizer, Crystal Lake, IL (US)

(73) Assignee: Wm. Wrigley Jr. Company, Chicago, IL (US)

( * ) Notice: Subject to any disclaimer, the term of this patent is extended or adjusted under 35 U.S.C. 154(b) by 1531 days.

(21) Appl. No.: 11/234,496

(22) Filed: Sep. 23, 2005

(65) Prior Publication Data

US 2007/0068891 A1 Mar. 29, 2007

(51) Int. Cl.
*B65D 51/04* (2006.01)

(52) U.S. Cl. ..... 220/254.2; 220/826; 215/235; 222/553

(58) Field of Classification Search ..... 220/254.2, 220/826; 215/235, 237; 222/556; 119/73
See application file for complete search history.

(56) References Cited

U.S. PATENT DOCUMENTS

| | | | |
|---|---|---|---|
| D203,137 | S | 12/1965 | Braun |
| 4,095,712 | A | 6/1978 | Perrella |
| 4,163,496 | A | 8/1979 | Dogliotti |
| 4,260,069 | A | 4/1981 | Juergens |
| D280,281 | S | 8/1985 | Conti et al. |
| D282,896 | S | 3/1986 | Conti et al. |
| D282,897 | S | 3/1986 | Conti et al. |
| 4,767,023 | A | 8/1988 | Hackmann et al. |
| 4,802,608 | A | 2/1989 | Hofmann |
| D318,231 | S | 7/1991 | Lay et al. |
| 5,219,100 | A | 6/1993 | Beck et al. |
| 5,385,267 | A | 1/1995 | Diamond et al. |
| 5,405,047 | A | 4/1995 | Hansen |
| 5,482,172 | A | 1/1996 | Braddock |
| 5,779,035 | A | 7/1998 | Marrelli et al. |
| 6,006,952 | A | 12/1999 | Lucas |
| 6,131,765 | A | 10/2000 | Barry et al. |
| 6,472,007 | B2 | 10/2002 | Bezek et al. |
| 6,596,328 | B1 | 7/2003 | Bezek et al. |
| D482,509 | S | 11/2003 | Lin |
| 6,763,964 | B1 * | 7/2004 | Hurlbut et al. ..... 220/254.3 |
| D495,956 | S | 9/2004 | Martinez |
| D502,396 | S | 3/2005 | Frisch et al. |
| D502,398 | S | 3/2005 | Leonzo et al. |

(Continued)

FOREIGN PATENT DOCUMENTS

| | | |
|---|---|---|
| EP | 0258885 | 3/1988 |

(Continued)

OTHER PUBLICATIONS

Xylitol—Sugar Free Gum, Lotte USA, Inc. [online] [printed on Nov. 17, 2006]. Retrieved from the Internet at <URL:http://www.lotteusainc.com/productspagexylitol.html>.

(Continued)

*Primary Examiner* — Anthony Stashick
*Assistant Examiner* — James N Smalley
(74) *Attorney, Agent, or Firm* — K&L Gates LLP

(57) ABSTRACT

A two-piece lid is provided and includes a base portion defining at least two openings of differing sizes and a single cover portion connected to the base for covering the openings. At least one opening is constructed as to maximize the size of the opening. A confectionery container comprising the two-piece lid is also provided.

2 Claims, 4 Drawing Sheets

U.S. PATENT DOCUMENTS

| | | | |
|---|---|---|---|
| 2004/0262315 | A1 | 12/2004 | Yoon |
| 2005/0040168 | A1 | 2/2005 | Solowiejko |

FOREIGN PATENT DOCUMENTS

| | | |
|---|---|---|
| EP | 0869075 | 10/1998 |
| WO | 95/34502 | 12/1995 |

OTHER PUBLICATIONS

Ice Breakers: to share or not to share, ADFREAK™.com, Available Feb. 2006.

Black Black Xylitol Gum One Push Dispenser, [online][printed on Nov. 17, 2006]. Retrieved from the Internet at <URL:http://www.clipclip.org/ptufts/clips/tag/blackblack>.

International Search Report (3 pgs.).

Written Opinion of the International Searching Authority (5 pgs.).

Written Opinion for International Application No. PCT/US2008/056068 mailed Aug. 29, 2008.

Partial European Search Report Application No./Patent No. 10153484.8-2308, 6 pgs.

* cited by examiner

TWO-PIECE CONTAINER LID ASSEMBLY

BACKGROUND

The present invention relates generally to packaging. More particularly, the present invention relates to containers for storing and dispensing confectionery products.

The packaging for confectionery products is important to the marketing and storage of the product. As such, containers for confectionery products come in a variety of sizes, shapes and designs. For example, containers can be hand-held containers, with an openable lid for the dispensing of small, individual pieces of confectionery product. Such containers are traditionally useful for dispensing of one individual product, or a small number of individual products, at a time. Alternately, containers may be larger, with an openable lid for dispensing many pieces at once.

Traditional containers are useful for a number of purposes. In particular, traditional containers keep products fresh and free from contaminants. Additionally, where a product consists of a number of small pieces, traditional containers are useful for maintaining them in a restricted space for easy carrying. Where the containers are larger, they are useful for maintaining a large number of small pieces in a convenient, often decorative, manner.

Many traditional containers, however, do not adequately allow for easy removal of the product. For example, where the container is located in a high-traffic area, such as a reception area, it may be desirable to dispense a larger number of pieces at a time. If the opening in the container is too small, significant amounts of agitation may be necessary to dispense a large number of pieces. Similarly, if the opening in the container is too small for a user to use his or her hand to remove the pieces, the contents of the container may be spilled, or the user may become frustrated and give up.

In this regard, many traditional containers do not provide a user with the choice of removal of multiple pieces, or removal of a small number of pieces. When a user desires a small number of pieces, where only a large opening is present it may become difficult to remove the pieces without spilling the contents. In these instances, the large opening is unnecessary and creates a burden on the user. Furthermore, a large opening may allow multiple users to inadvertently touch unwanted pieces of the product when trying to remove an individual portion, creating an unhygienic environment. It would be therefore useful to provide a container that allows the option of either removal of a large number of pieces or a small, individual portion.

Further, conventional containers are often manufactured using multiple pieces of material. For example, when several openings are found in the container, these openings require multiple covers for sealing the openings to maintain control and preservation of the pieces. The need for multiple covers makes the processing of such containers costly and time-consuming, as each cover is likely individually manufactured.

The present invention solves the deficiencies of the prior art.

SUMMARY

The present invention provides an apparatus for dispensing individual confectionery products. More particularly, the present invention provides a two-piece lid for a confectionery product container. The products in one embodiment are confectionery products. The teachings of the present invention, however, are not dependent upon the products being any particular type as long as the products can fit within and be dispensed by the product container lid described herein. The container herein, regardless of what product is being dispensed, is configured to be highly functional, as described.

The present invention provides a two-piece lid for a confectionery product container. The lid comprises a base and a single cover. The lid provides ease in dispensing of products, as well as ease in manufacturing.

The present invention provides in an embodiment, a two-piece lid comprising a base and a single cover. The base of the lid has at least two openings of differing size.

The present invention additionally provides in an embodiment a confectionery product container having a receptacle for the storage of confectionery products and a two-piece lid. The lid preferably comprises a base with at least two openings of differing sizes and a single cover.

In an embodiment, one opening of the base is utilized for dispensing of a large number of individual confectionery products, and another opening is utilized for dispensing a small number of products.

In an embodiment the cover is made of a single piece of material, separated into portions to cover the at least two openings.

In another embodiment, the cover comprises two portions connected by a hinge.

In an embodiment, the two portions of the cover are positioned in planes differing from one another.

In an embodiment, a cam is present to bias at least one portion of the cover in an open position.

In another embodiment, the confectionery product container is a jar.

In yet another embodiment, at least one opening in the base is angled. This angled shape maximizes the size of the opening.

In another embodiment, the cover is connected to the base by at least one hinge connection, at least one snap-fit connection, or combinations thereof.

It is therefore an advantage of the present invention to provide a product container for dispensing individual products.

It is a further advantage of the present invention to provide a product container that is compact and easily stored.

It is yet another advantage of the present invention to provide a product container that is stable and able to fit into standard cup holders.

Moreover, it is an advantage of the present invention to provide a product container that is controllable to dispense only a desired amount of product.

Yet further, it is an advantage of the present invention to provide a receptacle lid that is manufactured in two pieces to improve molding efficiency.

Still further, it is an advantage of the present invention to provide a receptacle lid that allows a product to be dispensed via reach-in access or shaking.

Additional features and advantages are described herein, and will be apparent from, the following Detailed Description and the figures.

DETAILED DESCRIPTION

The present invention provides a confectionery product container, including a two-piece lid. Although in the embodiment illustrated the confectionery products are illustrated as tablets of products, it will be understood that the products to be dispensed can be of any suitable shape and size. Examples of such shapes include pill, block, flat stick, pillow, round, rectangular, triangular, and any combination of same.

The container and lid in the embodiment described below are generally made of a plastic material. In an embodiment, the material is polyethylene or polypropylene. The present invention expressly includes, however, the container and lid being made of any suitable material. In an embodiment, the container is sized and shaped to be conveniently fit into a standard cup holder. However, it will be appreciated that the container and lid illustrated in the embodiment is expressly not limited to any particular size or shape.

Figure 1:
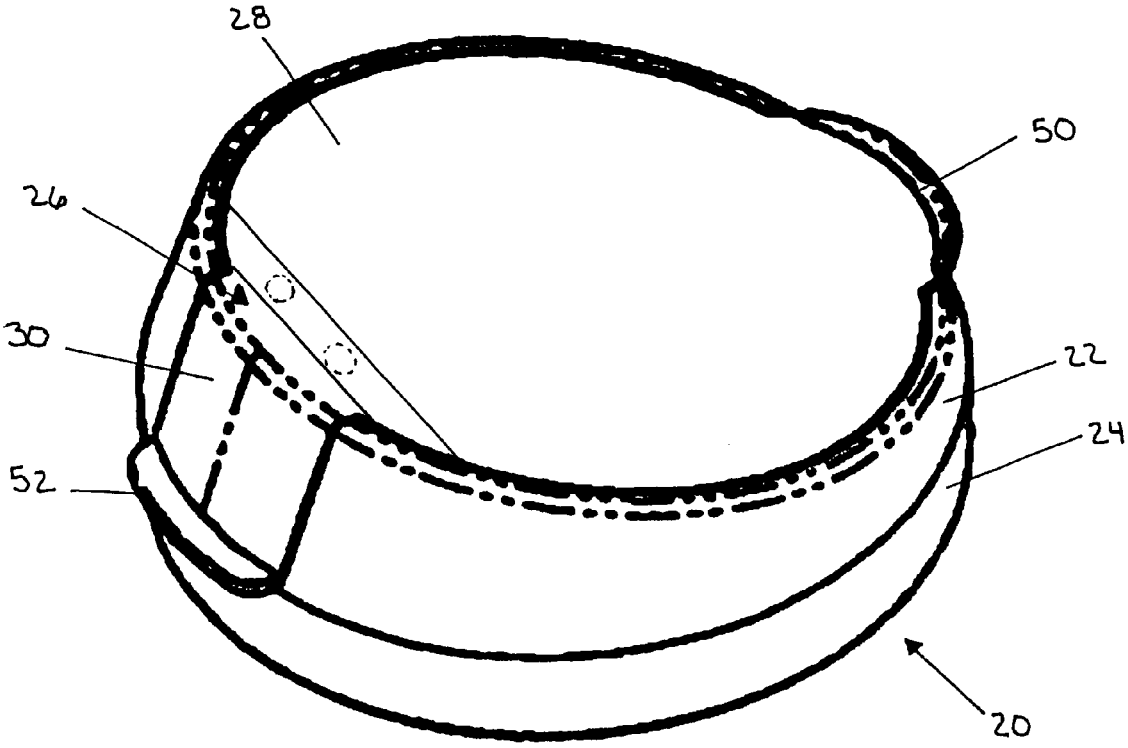
FIG. 1 illustrates a perspective view of one embodiment of the two-piece lid of the present invention.

Referring now to the drawings, and in particular to FIG. 1, one embodiment of a lid for a receptacle (not illustrated) for the dispensing of a confectionery product is illustrated as lid 20. The lid generally comprises a base 22 and a cover 26. As illustrated further below, both the base and the cover can be organized into portions, while maintaining their unitary structures and maintaining the two-piece construction of the lid. For example, the base 22 may comprise a skirt portion 24, while the cover may comprise a major portion 28 and a minor portion 30.

The shape of the base 22 of the lid 20 illustrated in FIGS. 1 to 4 is generally oval or circular. It should be appreciated that the base 22 can be shaped in order to configure with the shape of the receptacle (not illustrated) or of the opening of the receptacle. The receptacle may be any suitable size or shape, including but not limited to cubic, rectangular, pyramidal, cylindrical, conical and spherical. The receptacle defines an opening which enables the confectionery products to be dispensed or otherwise removed from the receptacle.

Figure 2:
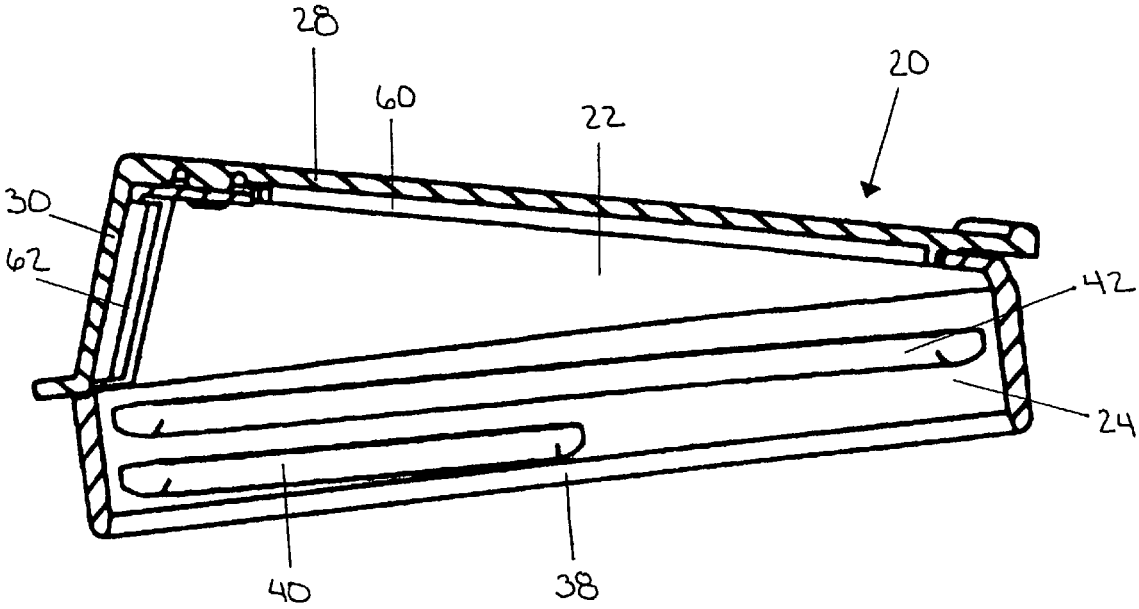
FIG. 2 illustrates a side cross-section view of the embodiment of the two-piece lid of FIG. 1.

In one embodiment, illustrated in FIG. 2, the lid contains threads 40, 42, so as to be fit with a receptacle via a twisting action. The threads may also be present around the opening of the receptacle. In another embodiment, the lid is manufactured so as to be snap-fit with a receptacle. It will be appreciated that the lid 20, may be removably attached to a receptacle via any known means. In an alternate embodiment the lid 20 is permanently attached to, or integral with, the receptacle.

Figure 3:
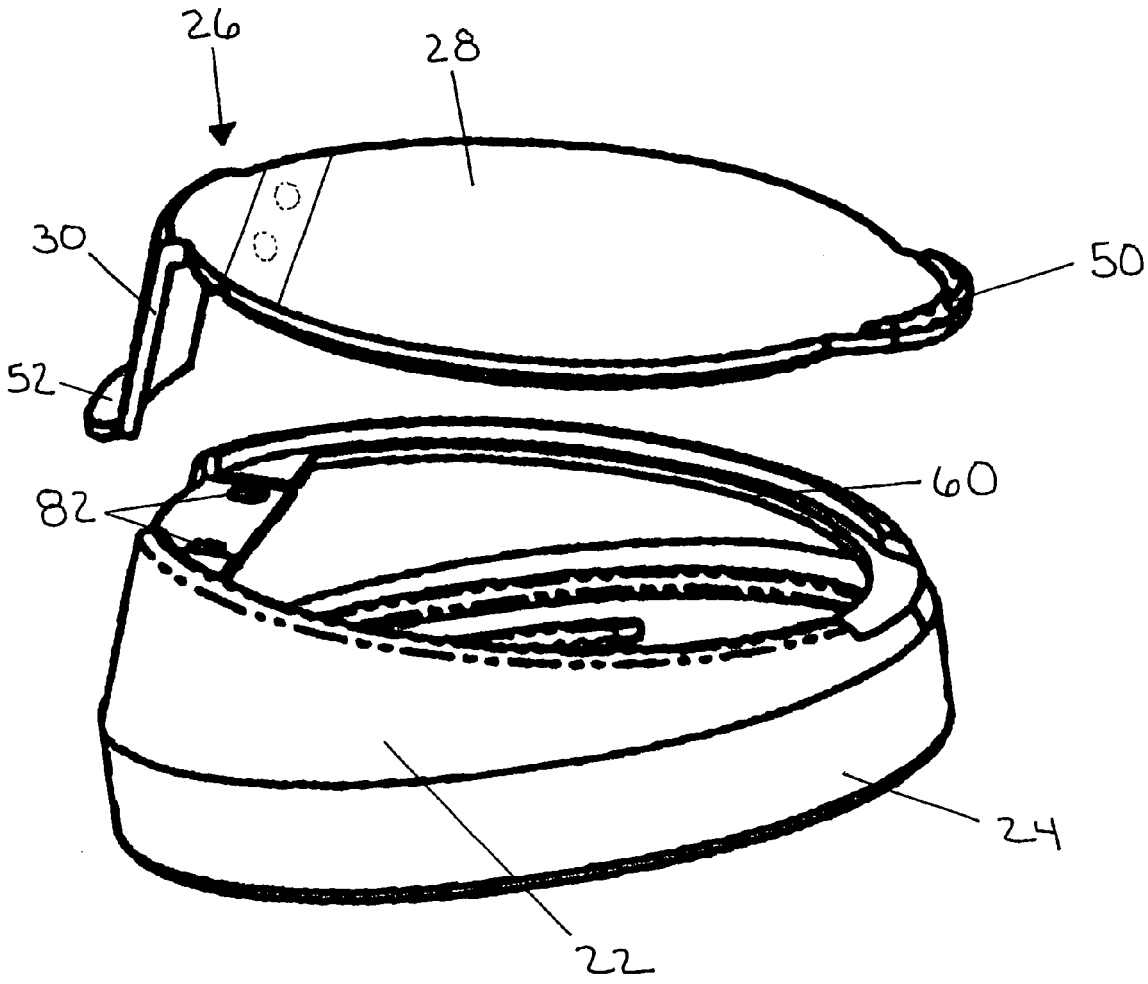
FIG. 3 illustrates a perspective view of the embodiment of the two-piece lid of FIG. 1, where the cover is removed from the base of the lid.
Figure 4:
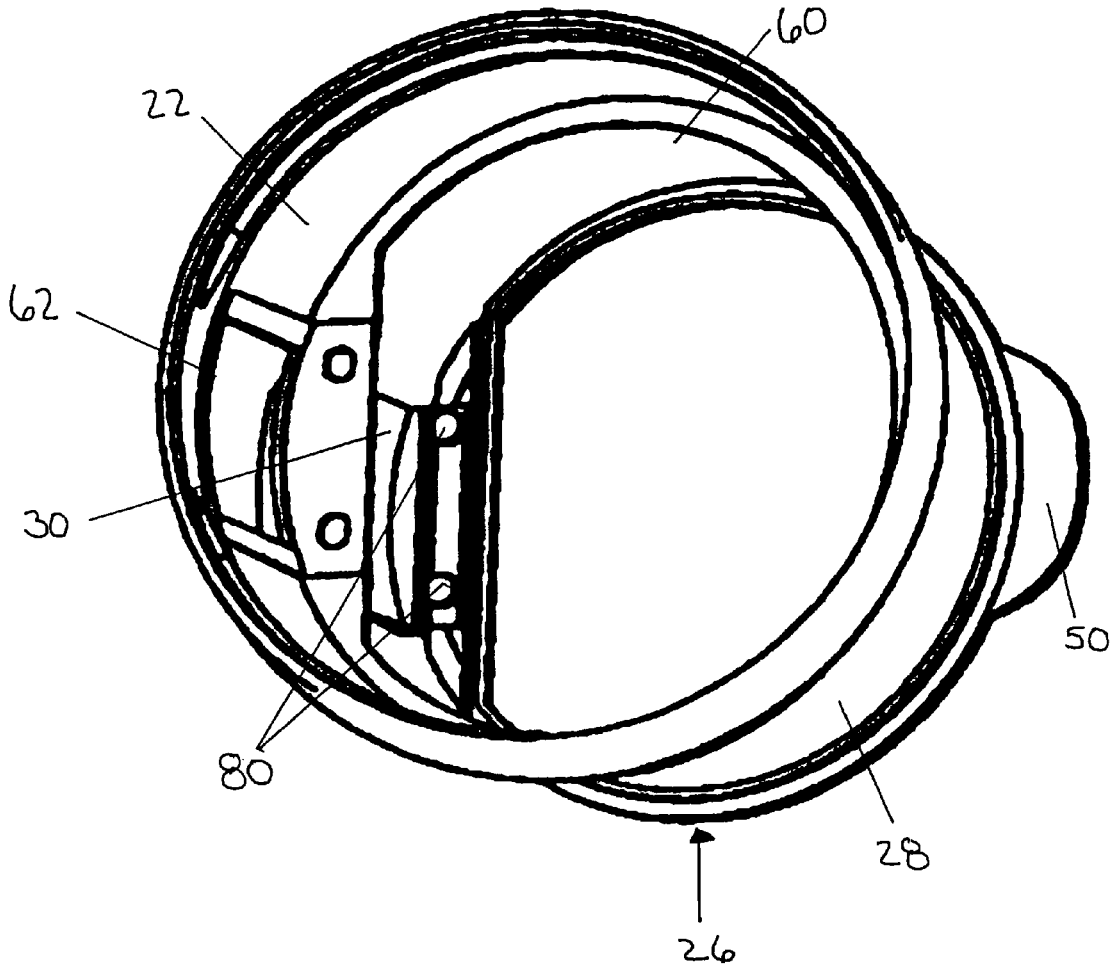
FIG. 4 illustrates a bottom perspective view of the two-piece lid of FIG. 1, where the cover is removed from the base of the lid.

As illustrated in FIGS. 3 and 4, the base 22 preferably defines a major opening 60, and a minor opening 62. These openings are of differing sizes that allow for removal of the product from the container in differing manners. In an embodiment, the major opening 60 and the minor opening 62, and their corresponding cover portions, are located in different planes relative to each other. It will be appreciated that any number and size of openings and corresponding cover portions may be present in the lid 20 of the present invention.

In an embodiment, as illustrated in the figures, the base and by extension the major opening 60 is angled. This allows the size of the major opening 60 to be increased, meaning the size of the opening is made larger than a planar opening would allow. Additionally, the angled base provides better viewing for labeling of the product. The major opening 60 provides easy reach-in access to the confectionery products, and, therefore, easy removal of a large number of products at once. As illustrated, angling the major opening 60 may require elevating one end of the base 22, creating a wedge-type shape in the base 22.

Additionally defined by the base 22 is a minor opening 62. As illustrated in FIGS. 3 and 4, particularly where the base is wedge-shaped to accommodate an angled major opening 60, the minor opening 62 is preferably located on the side of the base 22. The minor opening 62 is preferably sized to allow for dispensing of individual or a small number of products. Preferably, the minor opening 62 allows for the products to be shaken from the container, which provides ease of removal as well prevents multiple users from touching the remaining product. The presence of both a major opening 60 and a minor opening 62 allows differing quantities of products to be removed from the container in different ways.

Referring now specifically to the embodiment illustrated in FIG. 3, the cover 26 is sized and shaped to fit or over the openings defined by the base 22. The cover 26 may frictionally engage the base 22, and may include a flange or tab 50, 52 for securing the cover 26 to the base 22. A user grabs or holds the tab 50, 52 and places force against it to secure the cover 26. The tab 50, 52 may be any suitable size and shape. An optional lip 38 may also be present on the base 22 for securing the cover 26 to the base 22. In an embodiment, a cam is additionally present, to maintain a portion of the cover 26 in an open position. It will be appreciated that any other manner of securing the cover to the base may be utilized.

Preferably, the base portion 22 and cover 26 comprise two separate pieces of material. This configuration is present, regardless of the number of openings in the base 22, as, although multiple portions are defined by the cover 26, the cover is preferably made up of a single piece of material. FIG. 3 illustrates the minor portion of the cover 30 attached to the major portion of the cover 28 via an integral hinge.

As illustrated, the cover 26 is connected to the base 22. While it is desirable that the cover 26 is connected to the base 22 in a manner so as to allow the cover to pivot, it will be appreciated that any manner of connecting the cover to the base may be employed. In one embodiment, the cover 26 is movably attached to the base 22 by a hinge. The hinge is integrally formed with the base 22 and cover 26. It should be appreciated that any suitable hinge or hinges could be used to connect the cover 26 to the base 22. The hinge enables the cover 26 to pivot between an open position and a closed position.

In another embodiment, illustrated in FIGS. 3 and 4, the cover 26 is connected to the base 22 via a snap-fit system. According to this embodiment, the cover comprises pegs 80 that project from the underside of the cover 26. Preferably, these pegs project from the area at which the major portion 28 and the minor portion 30 of the cover are hinged. In the base 22 are holes 82 for receiving the pegs 80. The pegs 80 are configured to snap-fit with the holes 82, so as to attach the cover 26 to the base 22. In this embodiment the major portion 28 and minor portion 30 are still able to pivot to open or close the major 60 and minor 62 openings, respectively.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A two-piece lid for a confectionery product container comprising:

a base attachable to the container, wherein the base defines a first opening and a second opening having a different size than the first opening, wherein the first opening and the second opening are sized for dispensing the confectionery products and wherein the first opening and the second opening are in different planes; and a single cover having a major portion for removably covering the first opening and a minor portion for removably covering the second opening, wherein the major portion and the minor portion of the cover are positioned in planes differing from one another in a closed position, wherein the cover is connected to the base by at least one welded connection.

2. A two-piece lid for a confectionery product container comprising:

a base attachable to the container, wherein the base defines a first opening and a second opening having a different size than the first opening, wherein the first opening and the second opening are sized for dispensing the confectionery products and wherein the first opening and the second opening are in different planes; and a single cover having a major portion for removably covering the first opening and a minor portion for removably covering the second opening, wherein the major portion and the minor portion of the cover are positioned in planes differing from one another in a closed position, wherein the major portion and the minor portion of the cover are pivotable relative to one another.

* * * * *